US007192298B2

(12) United States Patent
Sinner et al.

(10) Patent No.: US 7,192,298 B2
(45) Date of Patent: Mar. 20, 2007

(54) APPARATUS TO PREVENT AN ELECTRICAL PLUG BEING UNPLUGGED

(76) Inventors: Steve A. Sinner, 162 Ezra Hall Rd., Science Hill, KY (US) 42553; William L. Nichols, 126 Griffin Ave., Somerset, KY (US) 42501-2208

( * ) Notice: Subject to any disclaimer, the term of this patent is extended or adjusted under 35 U.S.C. 154(b) by 0 days.

(21) Appl. No.: 11/248,077

(22) Filed: Oct. 12, 2005

(65) Prior Publication Data

US 2006/0270266 A1 Nov. 30, 2006

Related U.S. Application Data

(60) Provisional application No. 60/684,825, filed on May 26, 2005.

(51) Int. Cl.
*H01R 13/62* (2006.01)

(52) U.S. Cl. ..... 439/373; 439/470

(58) Field of Classification Search ..... 439/369–373, 439/470; 174/92

See application file for complete search history.

(56) References Cited

U.S. PATENT DOCUMENTS 2,659,059 A * 11/1953 Johnson ..... 439/373
4,083,618 A 4/1978 Busch, Jr.
4,105,274 A 8/1978 Casey
5,549,482 A 8/1996 Langlais et al.
5,591,043 A 1/1997 Kenney
5,639,049 A 6/1997 Jennings et al.
D401,559 S * 11/1998 Angell ..... D13/154
6,095,846 A 8/2000 Becerra
6,491,539 B1 12/2002 Johnston

* cited by examiner

*Primary Examiner*—Truc Nguyen
(74) *Attorney, Agent, or Firm*—James Ray & Assoc.

(57) ABSTRACT

An apparatus for preventing unplugging of an electrical plug from an electrical receptacle includes a unitary member having each of a predetermined shape a predetermined size and a predetermined thickness. An aperture is disposed within the unitary member for removably attaching it to a predetermined portion of such electrical receptacle. A second aperture is disposed in a predetermined portion of the unitary member and has an edge for applying a predetermined pressure onto a portion of an electrical cord integrally connected to such electrical plug for preventing unplugging thereof when such electrical plug is plugged into such electrical receptacle.

12 Claims, 4 Drawing Sheets

APPARATUS TO PREVENT AN ELECTRICAL PLUG BEING UNPLUGGED

CROSS-REFERENCE TO RELATED APPLICATIONS

This application is related to and claims priory from U.S. Provisional Patent Application Ser. No. 60/684,825 filed May 26, 2005.

FIELD OF THE INVENTION

The present invention relates, in general, wall plugs and, more particularly, this invention relates to devices for preventing accidental unplugging of electrical plugs from wall outlet sockets, outlet strips and extension cords.

BACKGROUND OF THE INVENTION

Various attempts have been made to prevent accidental unplugging of electrical plugs from electrical sockets. U.S. Pat. No. 4,105,274 to Casey, U.S. Pat. No. 4,083,613 to Busch, Jr., U.S. Pat. No. 5,549,482 to Langlais et al, U.S. Pat. No. 6,095,846 to Becerrs, U.S. Pat. No. 6,491,529 to Johnston and U.S. Pat. No. 5,591,043 to Kenney disclose various types of complex retainers and safety devices requiring complex manipulations to secure and release such electrical plugs.

SUMMARY OF THE INVENTION

According to one aspect, the invention provides an apparatus for preventing unplugging of an electrical plug from an electrical receptacle which includes a unitary member having each of a predetermined shape a predetermined size and a predetermined thickness. An aperture is disposed within the unitary member for removably attaching it to a predetermined portion of such electrical receptacle. A second aperture is disposed in a predetermined portion of the unitary member and has an edge for applying a predetermined pressure onto a portion of an electrical cord integrally connected to such electrical plug for preventing unplugging thereof when such electrical plug is plugged into such electrical receptacle.

According to another aspect, the invention provides an apparatus for preventing unplugging of at least one electrical plug from a plurality of electrical receptacles disposed in a predetermined alignment within a housing member. Such apparatus includes a unitary member having each of a predetermined shape, a predetermined size and a predetermined thickness. At least one mounting aperture is disposed within a predetermined portion of the unitary member for removably attaching it to a predetermined portion of such housing. A predetermined plurality of plug apertures, each aligned with a respective one of such plurality of electrical receptacles and disposed adjacent the at least one mounting aperture are disposed for enabling at least a partial passage of such at least one electrical plug therethrough. A predetermined peripheral edge of each of the plug apertures applies a predetermined pressure onto a portion of a respective electrical cord integrally connected to such electrical plug for preventing unplugging thereof when such electrical plug is plugged into such electrical receptacle.

According to yet another aspect, the invention provides a method for preventing unplugging of an electrical plug from an electrical receptacle disposed at one end of an electrical extension cord. The method includes the steps of providing a unitary member including an aperture having each of a predetermined shape and a predetermined size sufficient to enable each of the electrical receptacle and the electrical plug to pass therethrough. Passing the electrical receptacle through the aperture and passing the electrical plug through the aperture. Connecting the electrical plug to the electrical receptacle and sliding the unitary member towards a connection of the electrical plug with the electrical receptacle.

According to a further aspect, the invention provides a unitary member which is hingeably extends from the cover of such electrical outlet.

According to yet a further aspect, the invention provides an apparatus having a base portion with means for attaching the apparatus to a rigid surface. A leg portion extends from one end of the base portion and is capable of forming an aperture for caging the electrical cord. Locking tabs are provided to secure the leg portion and form such aperture.

OBJECTS OF THE INVENTION

It is, therefore, one of the primary objects of the present invention to provide an apparatus for preventing accidental unplugging of electrical plugs from electrical sockets.

Another object of the present invention is to provide an apparatus for preventing accidental unplugging of electrical plugs from electrical sockets which is simple to manufacture.

Yet another object of the present invention is to provide an apparatus for preventing accidental unplugging of electrical plugs from electrical sockets which significantly reduces the manual effort to secure and release such electrical plugs.

A further object of the present invention is to provide an apparatus for preventing accidental unplugging of electrical plugs from electrical sockets which does not require use of special tools.

Yet a further object of the present invention is to provide an apparatus for preventing accidental unplugging of electrical plugs from electrical sockets which prevents access to the electrical socket when the electrical plug is unplugged.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
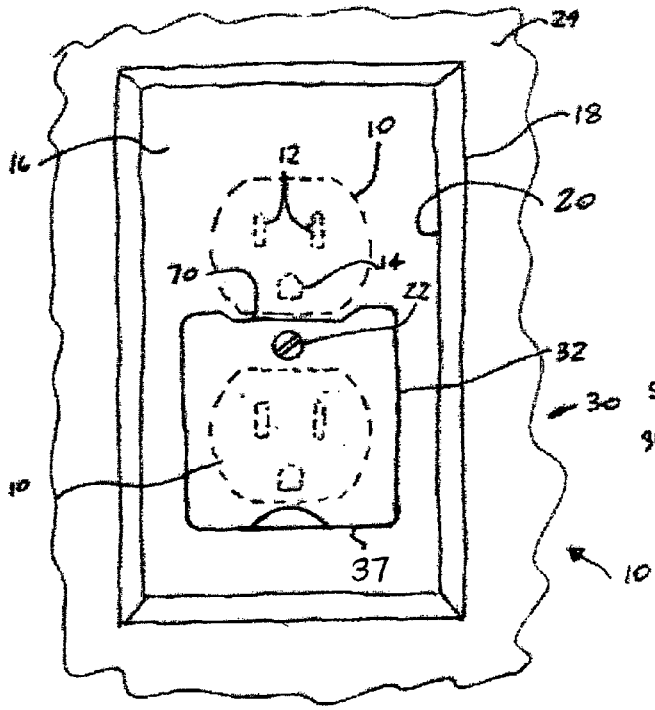
FIG. 1 is a front elevation view of an apparatus for preventing unplugging of an electrical plug plugged into an electrical outlet.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
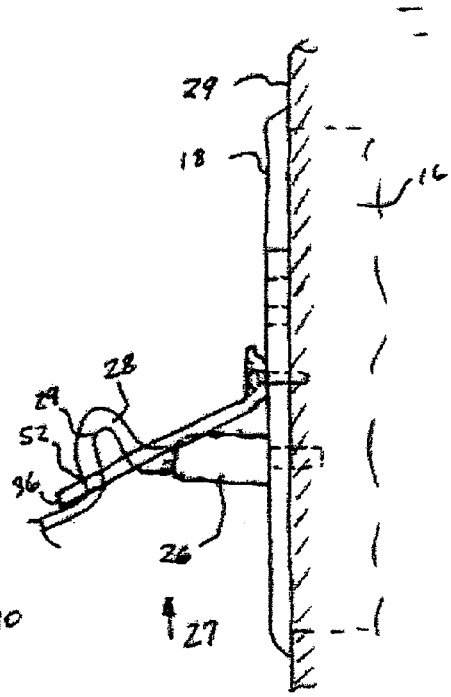
FIG. 2 is a side elevation view of an apparatus of the present invention of FIG. 1.
Figure 3:
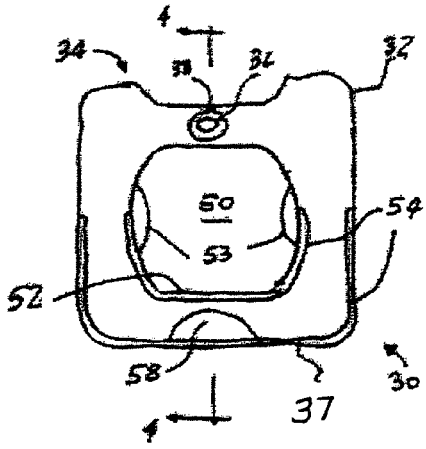
FIG. 3 is a front elevation view of an apparatus for preventing unplugging of an electrical plug according to the presently preferred embodiment of the invention.

Reference is now made, to FIGS. 1–2, wherein there is shown an electrical receptacle 10 characterized by well known apertures 12 and a ground aperture 14 for receiving prongs of the electrical plug 26. The electrical receptacle 10 is generally disposed within an electrical power outlet 16 further including a cover 18 having an aperture 20 for fitting around the peripheral edge of the electrical receptacle 10 and which is attached with at least one threaded fastener 22. FIG. 1, illustrates a well known type of electrical outlet 16 containing a pair of aligned electrical receptacles 10 with the threaded fastener 22 disposed therebetween. Such electrical outlet 16 is generally attached to a rigid surface such as a wall 29 of a building (not shown).

An apparatus, generally designated 30, is provided for preventing unplugging of the electrical plug 26 from the electrical receptacle 10. According to one embodiment of the invention, the apparatus 30 includes a unitary member 32 having each of a predetermined shape, a predetermined size and a predetermined thickness. The presently preferred shape of such unitary member 32 includes a substantially planar surface when such unitary member 32 is disposed in a non operable position. The presently preferred material of such unitary member 32 is a predetermined plastic having a predetermined rigidity enabling bending of the unitary member 30 during plugging and unplugging of the electrical plug 26 and return of the unitary member 30 into the non operable position when the electrical plug 26 is unplugged.

Means, generally designated 34, is engageable with the unitary member 32 for removably attaching it to one of a predetermined portion of such electrical receptacle 16, the electrical socket 10 and the cover 18. Preferably, such attachment means 34 includes a mounting aperture 36 for removably attaching the unitary member 32 to a surface portion of such cover 18 with such threaded fastener 22.

Such attachment means 34 may further include a slot 38 connected to the mounting aperture 36 at one end and to an edge of the unitary member 32 at a distal end for enabling a partial disengagement of such threaded fastener 22 from such surface portion of such cover 18 for one of attachment and removal of the apparatus 30.

Figure 5:
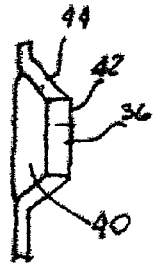
FIG. 5 is an enlarged partial side view of an apparatus of the present invention of FIG. 3.

Alternatively, such attachment means 34 may include a depression 40, best shown in FIG. 5, formed in the unitary member 32 which has a base portion 42 engaging a surface portion of such cover 18 and a wall portion 44 extending along a circumference of the base portion 42 at a predetermined angle to a surface of the unitary member 32. The base portion 42 has a mounting aperture 36 disposed therein for enabling passage of a threaded stem of such fastener 22, wherein a head of such fastener 22 is at least partially contained within the wall portion 44 of the depression 40. Preferably, the thickness of the base portion 42 is greater than the thickness of the unitary member 32 to increase rigidity of the apparatus 10 and prevent curling of such unitary member 32 during attachment thereof at the mounting aperture 36. Alternatively, such base portion 42 may be integrally formed from a metallic material containing such mounting aperture 36.

Figure 7:
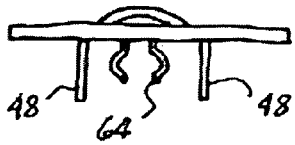
FIG. 7 is an end elevation view of an apparatus for preventing unplugging of an electrical plug according to another alternative embodiment of the invention.

Alternatively, the attachment means 34 may include at least one elongated member 48, best shown in FIG. 7, extending outwardly from a surface of the unitary member 32 for insertion into at least one aperture 12 of the adjacently disposed second electrical socket 10.

It is further preferred that the apparatus 10 includes a plug aperture 50 for enabling at least partial passage of such electrical plug 26 therethrough. At least a portion of a peripheral edge of such plug aperture 50 may be reinforced with a generally rounded rib means 54 which will further aid in preventing chaffing of the electrical cord 28. Furthermore, such rib means 54 may at least partially extend along the peripheral edge of the unitary member 32.

In operation, as illustrated in FIG. 2, the unitary member is attached to the electrical outlet 16 with the threaded fastener 22. A predetermined portion of the unitary member 32, such as an edge 36, is lifted away from such electrical receptacle 10. The electrical plug 26 is passed through the plug aperture 50 in a direction 27 in FIG. 2 and a loop 29 is formed in the portion of an electrical cord 28 which is disposed immediately adjacent the electrical plug 26. The edge 36 is then lowered to engage a portion of an electrical cord 28 which preferably in combination with the lower edge 52 of the plug aperture 50 applies a predetermined pressure onto the electrical cord 28 for preventing unplugging of such electrical plug 26. It will be appreciated that FIG. 1 illustrates a non operable position of the unitary member 32.

When the plug aperture 50 is provided, its peripheral edge is formed to provide clearance with the electrical plug 26 to enable such predetermined pressure to be applied to the portion of the electrical cord 28. Alternatively and in combination, a portion 53 of such peripheral edge may be hingeably attached to the unitary member 32 to first enable passage of the electrical plug 26 and then apply a pressure onto a predetermined portion thereof.

Figure 4:
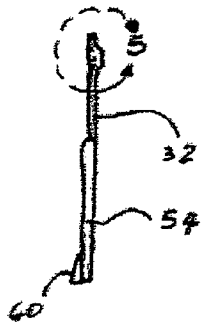
FIG. 4 is a side elevation view of an apparatus of the present invention along lines 4—4 of FIG. 3.

To facilitate such manual lifting of the unitary member 32, the edge 36 is provided with a grip means 58 which preferably includes a raised portion 60, best shown in FIG. 4.

Figure 6:
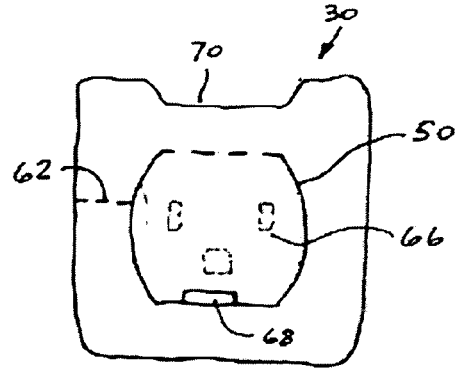
FIG. 6 is a front elevation view of an apparatus for preventing unplugging of an electrical plug according to an alternative embodiment of the invention.

Alternatively, a slit 62, shown in FIG. 6, may be disposed between the plug aperture 50 and a predetermined edge of the unitary member 32 for enabling a passage of such electrical cord 28 and its subsequent placement under the predetermined portion 36 for applying the predetermined pressure without requiring a manual lifting of the unitary member 32.

To secure the portion of the electrical cord 28 to the unitary member 32, a bifurcated clamp means 64, shown in FIG. 7, may be attached or disposed integrally to the rear surface of the unitary member 32.

For safety purposes, particularly when a presence of a small child is a concern, the apparatus 10 may further include a safety cover 66 hingeably attached to the unitary member 32 for releaseably covering the plug aperture 50. Such safety cover 66 may be provided with a slot 68 for facilitating lifting of the cover 64 with a narrow sharp object such as a screwdriver. Alternatively, such cover 66 may be adapted for pivotal attachment with the threaded fastener 22.

Those skilled in the art will readily understand that the apparatus 10 according to the embodiment of the invention discussed supra may be applied to an electrical receptacle 10 disposed in an electrical outlet strip (not shown).

When a pair of electrical receptacles 10 is disposed within the electrical outlet 16, the unitary member 32 may include a recess portion 70 for providing a predetermined clearance with a second electrical receptacle 10.

Figure 8:
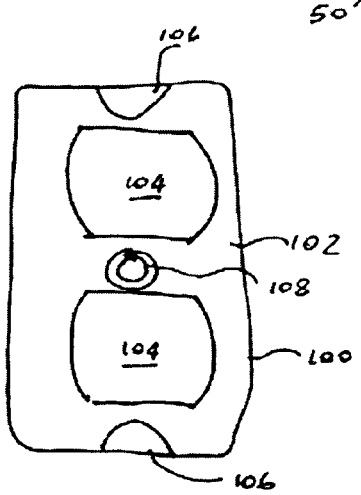
FIG. 8 is a front elevation view of an apparatus for preventing unplugging of an electrical plug according to yet another alternative embodiment of the invention.

In a particular reference to FIG. 8, therein illustrated another embodiment of the apparatus 100 for preventing unplugging of at least one electrical plug 26 from a pair of axially aligned and spaced electrical receptacles 10 which may be separated by the threaded fastener 22. The apparatus 100 includes a unitary member 102 having a pair of axially aligned plug apertures 104 each aligned with a respective one of such pair of receptacles 10 and further includes at least one mounting aperture 108. The unitary member 102 may be provided with a pair of grip means 106 each disposed adjacent a respective plug aperture 104.

Figure 9:
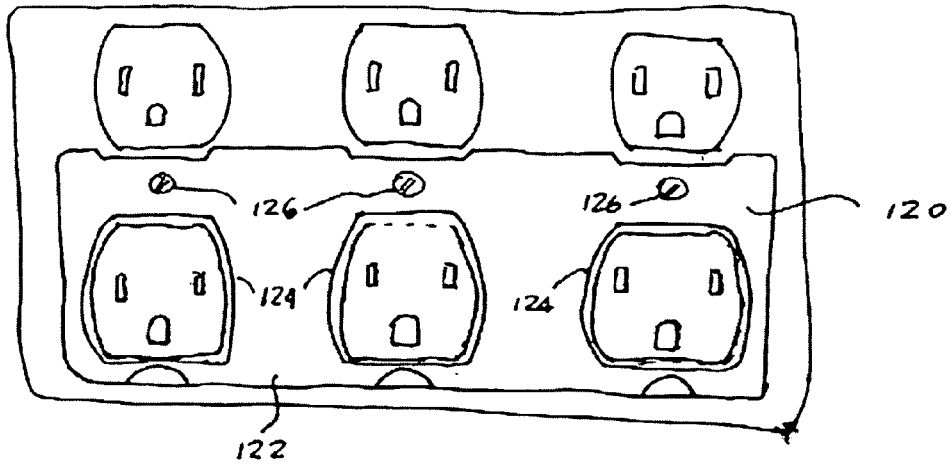
FIG. 9 is a front elevation view of an apparatus for preventing unplugging of an electrical plug according to still another alternative embodiment of the invention.

In yet another embodiment of the present invention, best illustrated in FIG. 9, the apparatus 120 is provided for use with a plurality of electrical receptacles 10. In such embodiment, the unitary member 122 is adapted with such plurality of plug apertures 124 each aligned with a respective one of a plurality of electrical receptacles 10. At least one and, preferably a predetermined plurality of mounting apertures 126 are provided for attaching the apparatus 120.

Figure 10:
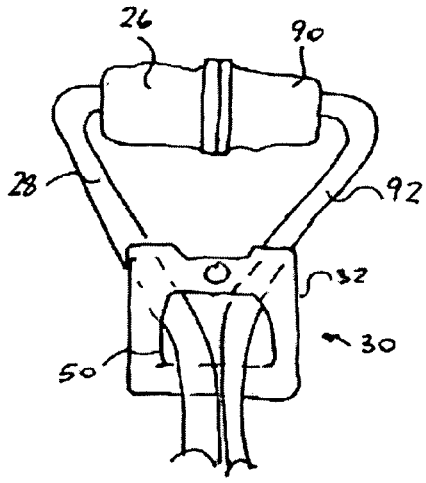
FIG. 10 is a front elevation view of an apparatus for preventing unplugging of an electrical plug plugged into a socket of an extension cord.

Advantageously, the unitary member may be utilized for preventing unplugging of the electrical plug 26 plugged into the electrical receptacle 90 disposed at one end of an electrical extension cord 92, as illustrated in FIG. 10. In such embodiment, the electrical receptacle 90 and the electrical plug 26 are passed through the plug aperture 50, sized for enabling passage thereof, and connected therebetween. The unitary member 22 is then slid towards the connection of the electrical receptacle 90 with the electrical plug 26 with the plug aperture 50 applying pressure onto the electrical cord 28 and the extension cord 92.

Figure 11:
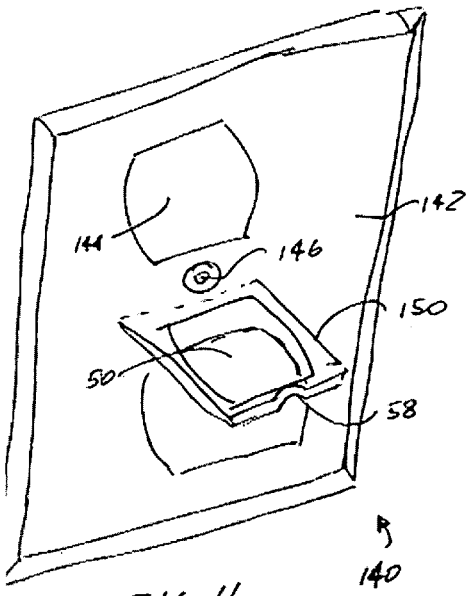
FIG. 11 is a perspective view of an apparatus for preventing unplugging of an electrical plug according to a further embodiment of the invention, particularly illustrating a unitary member hingeably extending from a cover member.
Figure 12:
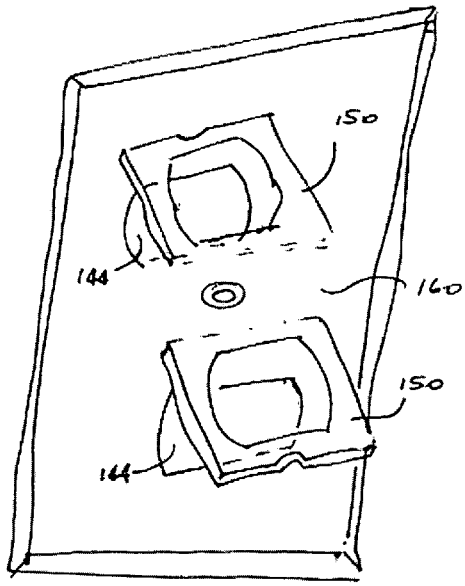
FIG. 12 is a perspective view of an apparatus for preventing unplugging of an electrical plug according to an alternative embodiment of the invention of FIG. 11.
Figure 13:
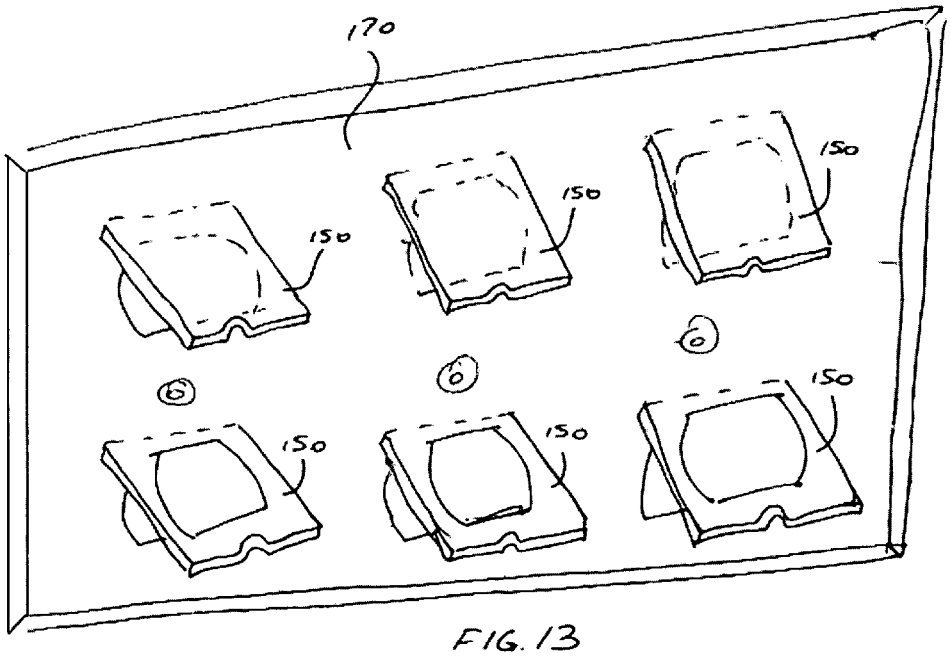
FIG. 13 is a perspective view of an apparatus for preventing unplugging of an electrical plug according to another alternative embodiment of the invention of FIG. 11.

FIGS. 11–13 illustrate a further embodiment of an apparatus, generally designated 140, for preventing unplugging of at least one electrical plug 26 from at least one electrical receptacle 10. In a particular reference to FIG. 11, such apparatus 140 includes a cover 142 having at least one aperture 144 for fitting around the at least one receptacle 10 and a mounting aperture 146. There is at least one unitary member 150 having each of a predetermined shape, a predetermined size and a predetermined thickness which is integrally and hingeably extends from the cover 142 and is aligned with the at least one electrical receptacle 10. The unitary member 150 is hingeably movable into a first position being coplanar with a surface of such electrical receptacle 10 and movable into a second position away from such at least one electrical receptacle 10 for applying a predetermined pressure onto at least a portion of the electrical cord 28 extending form such electrical plug 26 for preventing unplugging thereof. According to the embodiments described supra, the unitary member 150 may be adapted with aperture 50, grip means 58 and reinforcing means such as rib 54.

FIG. 12 illustrates a cover 160 having a pair of apertures 144 each fitting around a respective one of the pair of electrical receptacles 10 and a pair of unitary members 150 each aligned with a respective one of the pair apertures 144 and further with a respective one of the pair of electrical receptacles 10.

FIG. 13 illustrates a cover 170 adapted with a plurality of hingeably attached unitary members 150 for cooperating with a plurality of electrical receptacles 10.

Figure 15:
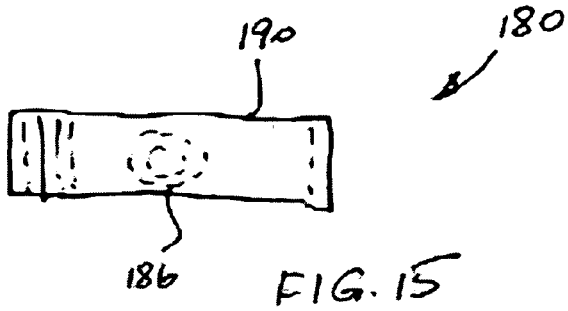
FIG. 15 is planar view of the apparatus of FIG. 14.
Figure 14:
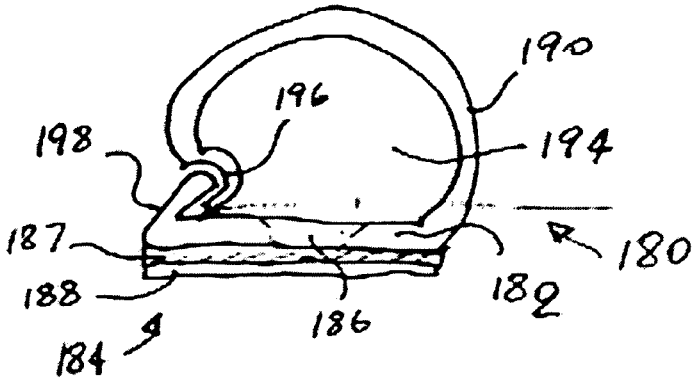
FIG. 14 is a front elevation view of the apparatus for preventing unplugging of an electrical plug according to yet another embodiment of the invention.
Figure 16:
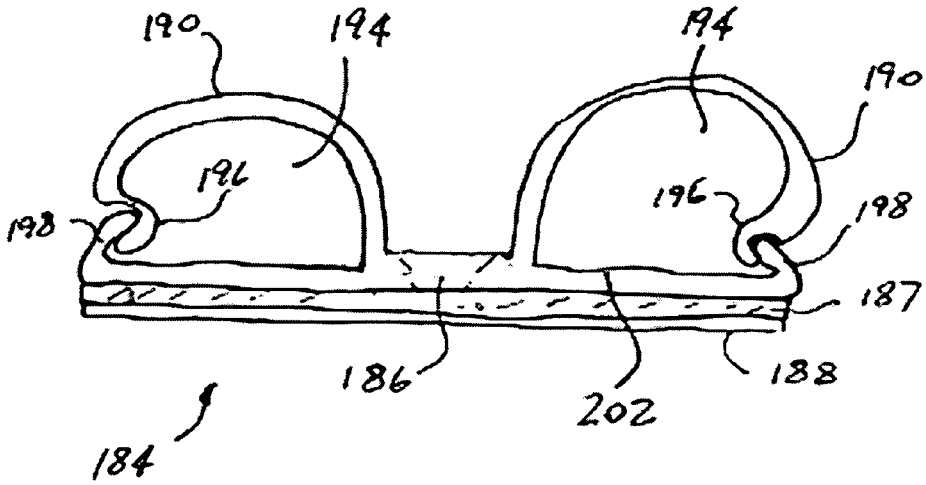
FIG. 16 is a front elevation view of the apparatus for preventing unplugging of an electrical plug according to an alternative embodiment of the invention of FIG. 14.

FIGS. 14–16 illustrate yet a further embodiment of the apparatus, generally designated 180, for preventing unplugging at least one electrical plug 26 from at least one electrical receptacle 10. In a particular reference to FIG. 14–15, such apparatus 180 includes a base portion 182 having means, generally designated 184, engageable therewith for attaching the apparatus 180 to a rigid surface adjacent the at least one electrical receptacle 10. Preferably, such attachment means 184 includes a mounting aperture 186 for removably attaching the base portion 182 to a surface portion of a cover 18 with such threaded fastener 22. Alternatively or in combination, attachment means 184 may include an adhesive means 187 engageable with the base portion 182 for attaching thereof to one of a predetermined portion of such electrical receptacle 16, the electrical socket 10 and the cover 18.

Such adhesive means 187 may be applied during installation of the apparatus 180 or may be attached to the base portion 182 and adapted with a removable cover 188. Yet alternatively, the base portion 182 may be disposed integral to one of such electrical receptacle 16 and the cover 18.

A leg portion 190 extends from one end of the base portion 182 and is capable of forming an aperture 194 having a predetermined shape and a predetermined size sufficient to cage at least one electrical cord 28 extending from the at least one electrical plug 26. The preferred shape of such aperture 194 is at least partially round. A first locking means 196 is disposed at a free end of the leg 190 and a second locking means 198 is disposed at an opposed end of the base portion 182. The second locking means 198 cooperate with the first locking means 196 to form the aperture 194 and retain the at least one electrical cord 28 therein when the at least one electrical plug 26 is plugged into the at least one electrical receptacle 10.

Such first locking means 196 and such second locking means 198 may be of any well known locking type utilized for removably securing electrical cables or wires and, preferably, such first locking means 196 and such second locking means 198 are a pair of interlocking tabs 196 and 198 as shown in FIG. 14. It will be appreciated that a second leg (not shown) may be disposed intermediate such opposed end of the base portion 182 and the second locking means 198.

When the attachment means 184 is such mounting aperture 186, the leg portion 190 is pivoted away from the base portion 182 in order to insert or remove the fastener 22.

FIG. 16 illustrates an apparatus 200 containing at least a pair of legs 190 extending from a common base portion 202, at least one attachment means 184 engageable with such common base portion 202 and at least one a pair of locking means 196 and 198 each associated with a respective one of the pair of legs 190.

Although the present invention has been shown in terms of the apparatus 30 utilized for preventing unplugging of the conventional electrical plug, it will be apparent to those skilled in the art, that the present invention may be applied to other objects plugged into the electrical receptacle 10. For example, such apparatus 30 may be utilized for preventing unplugging of a well known DC adapter. The size of the apparatus 30 will be adapted to accommodate a larger size of the DC adapter and a portion of the unitary member may be formed to at least partially encase such DC adapter and further apply a predetermined pressure to a portion thereof.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. An apparatus for preventing unplugging of an electrical plug from an electrical receptacle, said apparatus comprising:

(a) a unitary member having each of a predetermined shape, a predetermined size and a predetermined thickness, said unitary member having a recess portion formed therein for providing a predetermined clearance with a second electrical receptacle which is disposed adjacent such electrical receptacle;

(b) means engageable with said unitary member for removably attaching it to a predetermined portion of such electrical receptacle; and (c) means disposed in a predetermined portion of said unitary member for applying a predetermined pressure onto a portion of an electrical cord integrally connected to such electrical plug for preventing unplugging thereof when such electrical plug is plugged into such electrical receptacle.

2. The apparatus, according to claim 1, wherein said pressure applying means is a predetermined portion of a peripheral edge of an aperture disposed within said unitary member, said aperture enabling at least partial passage of such electrical plug therethrough.

3. The apparatus, according to claim 1, wherein said electrical receptacle includes an electrical outlet having a cover attached thereto with a threaded fastener and said attachment means is an aperture for attaching said unitary member to a surface portion of such cover with such threaded fastener.

4. The apparatus, according to claim 1, wherein said electrical receptacle includes an electrical outlet having a cover attached thereto with a threaded fastener and said attachment means includes a depression formed in said unitary member, said depression having a base portion engaging a surface portion of such cover and a wall portion extending along a circumference of said base portion at a predetermined angle to a surface of said unitary member, said base portion having an aperture disposed therein for enabling passage of a threaded stem of such fastener, wherein a head of such fastener is at least partially contained within said wall portion of said depression.

5. The apparatus, according to claim 1, wherein said predetermined shape of said unitary member is substantially planar.

6. The apparatus, according to claim 1, wherein said unitary member includes a grip means for manually lifting said unitary member prior to plugging such electrical plug.

7. The apparatus, according to claim 1, wherein said apparatus includes a rib means at least partially extending along the peripheral edge of said unitary member.

8. The apparatus, according to claim 2, wherein at least a portion of a peripheral edge of said aperture is hingeably attached to said unitary member for applying said predetermined pressure onto a portion of such electrical plug.

9. The apparatus, according to claim 3, wherein said attachment means further includes a slot connected to said aperture at one end and to an edge of said unitary member at a distal end for enabling a partial disengagement of such threaded fastener from such surface portion of such cover for one of attachment and removal of said apparatus.

10. The apparatus, according to claim 2, wherein said apparatus includes a rib means at least partially extending along said peripheral edge of said aperture for reinforcing said aperture and for preventing chaffing of such electrical cord.

11. An apparatus for preventing unplugging of an electrical plug from an electrical receptacle, said apparatus comprising:

(a) a unitary member having each of a predetermined shape, a predetermined size and a predetermined thickness;

(b) an aperture formed in said unitary member for enabling at least partial passage of such electrical plug therethrough;

(c) means engageable with said unitary member for removably attaching it to a predetermined portion of such electrical receptacle; and (d) means for applying a predetermined pressure onto a portion of an electrical cord integrally connected to such electrical plug for preventing unplugging thereof when such electrical plug is plugged into such electrical receptacle, said pressure applying means having a predetermined portion of a peripheral edge of said aperture being hingeably attached to said unitary member for applying said predetermined pressure.

12. The apparatus, according to claim 11, wherein said unitary member includes a recess portion for providing a predetermined clearance with a second electrical receptacle.

* * * * *